US007580618B2

(12) United States Patent
Suzuki et al.

(10) Patent No.: US 7,580,618 B2
(45) Date of Patent: Aug. 25, 2009

(54) WATER HEATING APPARATUS

(75) Inventors: Takashi Suzuki, Nagoya (JP); Masayoshi Takayama, Nagoya (JP)

(73) Assignee: Rinnai Corporation, Aichi-ken (JP)

( * ) Notice: Subject to any disclaimer, the term of this patent is extended or adjusted under 35 U.S.C. 154(b) by 106 days.

(21) Appl. No.: 11/754,595

(22) Filed: May 29, 2007

(65) Prior Publication Data

US 2007/0280656 A1 Dec. 6, 2007

(30) Foreign Application Priority Data

May 31, 2006 (JP) ..... 2006-151124

(51) Int. Cl.
*F24H 1/18* (2006.01)

(52) U.S. Cl. ..... 392/441; 392/465; 392/484

(58) Field of Classification Search ..... 392/465, 392/484

See application file for complete search history.

(56) References Cited

U.S. PATENT DOCUMENTS 4,638,147 A * 1/1987 Dytch et al. ..... 392/485
4,713,525 A * 12/1987 Eastep ..... 392/465
5,058,804 A * 10/1991 Yonekubo et al. ..... 236/12.12
5,504,306 A * 4/1996 Russell et al. ..... 219/497
5,626,287 A * 5/1997 Krause et al. ..... 236/20 R
6,246,831 B1 * 6/2001 Seitz et al. ..... 392/486
6,351,603 B2 * 2/2002 Waithe et al. ..... 392/474
6,590,188 B2 * 7/2003 Cline et al. ..... 219/497
D483,451 S * 12/2003 Yamamoto et al. ..... D23/320
6,806,446 B1 * 10/2004 Neale ..... 219/497
7,346,274 B2 * 3/2008 Bradenbaugh ..... 392/478

FOREIGN PATENT DOCUMENTS

JP 2003-194396 7/2003

* cited by examiner

*Primary Examiner*—Thor S Campbell
(74) *Attorney, Agent, or Firm*—Turocy & Watson, LLP

(57) ABSTRACT

A water heating apparatus comprising: a device body for heating and producing hot water that is capable of connecting to one or more remote control units for remotely operating the device body, the device body having an outer casing; a connection-number counter disposed within the outer casing of the device body for determining the number of remote control units upon powering-up the device body; and a display unit disposed within the outer casing of the device body for indicating the number of the connected remote control units determined by the connection-number counter, wherein a display of the display unit is visible from the exterior through a window formed in the outer casing.

6 Claims, 6 Drawing Sheets

| SW No | | | | | |
|---|---|---|---|---|---|
| 7(67) | Off | Normal | On | Forced high combustion | On | Forced low combustion |
| 8(68) | Off | | Off | | On | |

Fig. 4

WATER HEATING APPARATUS

BACKGROUND OF THE INVENTION

1. Field of the Invention

The present invention relates to a water heating apparatus. The invention can be applied to a water heating apparatus for use in reheating bath water, air-heating, and hot water supply.

2. Description of the Related Art

As a water heating apparatus for supplying hot water to a water heating place such as a kitchen and a bathroom, and to a heat radiating mat for floor heating, there is widely known a water heating apparatus having a device body for heating and producing hot water, and a remote control unit for setting the temperature of hot water which is heated and produced by the device body.

Conventionally, when a water heating apparatus of this kind is to be installed, the device body is disposed in an outdoor device installing place out of doors, and the device body is connected to a hot water faucet of a kitchen, a radiating mat for floor heating disposed in a living room and a bathtub of a bathroom through piping. In the case of the water heating apparatus which has the device body connected to the remote control unit, the remote control unit is mounted on a wall surface of the kitchen, the living room or the bathroom and then, the remote control unit and the device body are connected to each other through a communication line, thereby completing the installation operation.

In the water heating apparatus, when the temperature is set by the remote control unit installed in the kitchen, the living room or the bathroom, hot water of the set temperature is heated and produced by the device body, and is supplied to the kitchen, the living room or the bathroom. If an operation mode such as a hot water filling mode or a heating mode is selected by means of a mode selection switch provided on the remote control unit, the hot water filling operation into the bathtub, or a hot water supplying operation (heating operation) to a heat radiating mat is carried out. (For example, Japanese Unexamined Patent Publication No. 2003-194396)

In the conventional water heating apparatus, however, when an installation operator carries out the checking operation whether the intended number of the remote control units to be installed and the number of actually installed remote control units match with each other after the installation operation is completed, the installation operator must walk to all of the installed places of the remote control units, for example, to the kitchen to confirm whether there is a remote control unit. Thus, the checking operation is complicated.

Further, even when a remote control unit is actually installed in the remote control unit installing place such as a kitchen, it is necessary for the installation operator to confirm whether the communication line is normally connected to the remote control unit and the device body. This also complicates the installation operation.

SUMMARY OF THE INVENTION

The present invention has been accomplished in view of the circumstances, and it is an object of the invention to make it easy to confirm the number of installed remote control units at an installing place of the device body, thereby facilitating the installation operation, whether a water heating apparatus having the device body for heating and producing hot water connected to a remote control unit for remotely operating the device body, or a water heating apparatus having the device body for heating and producing hot water not connected to the remote control unit for remotely operating the device body is installed.

According to one aspect of the invention, there is provided a water heating apparatus comprising:

a device body for heating and producing hot water that is capable of connecting to one or more remote control units for remotely operating the device body, the device body having an outer casing;

a connection-number counter disposed within the outer casing of the device body for determining the number of remote control units upon powering-up the device body; and a display unit disposed within the outer casing of the device body for indicating the number of the connected remote control units determined by the connection-number counter, wherein a display of the display unit is visible from the exterior through a window formed in the outer casing.

Other objects, features and advantages of the present invention will become more fully understood from the detailed description given hereinbelow and the accompanying drawings which are given by way of illustration only, and thus are not to be considered as limiting the present invention.

BRIEF DESCRIPTION OF THE DRAWINGS

FIG. 4 is a table showing a relation of a change-over state of a seventh switch and an eighth switch of an auxiliary temperature setting unit and a control state of a gas burner according to the embodiment of the present invention;

DETAILED DESCRIPTION OF THE PREFERRED EMBODIMENT

Figure 1:
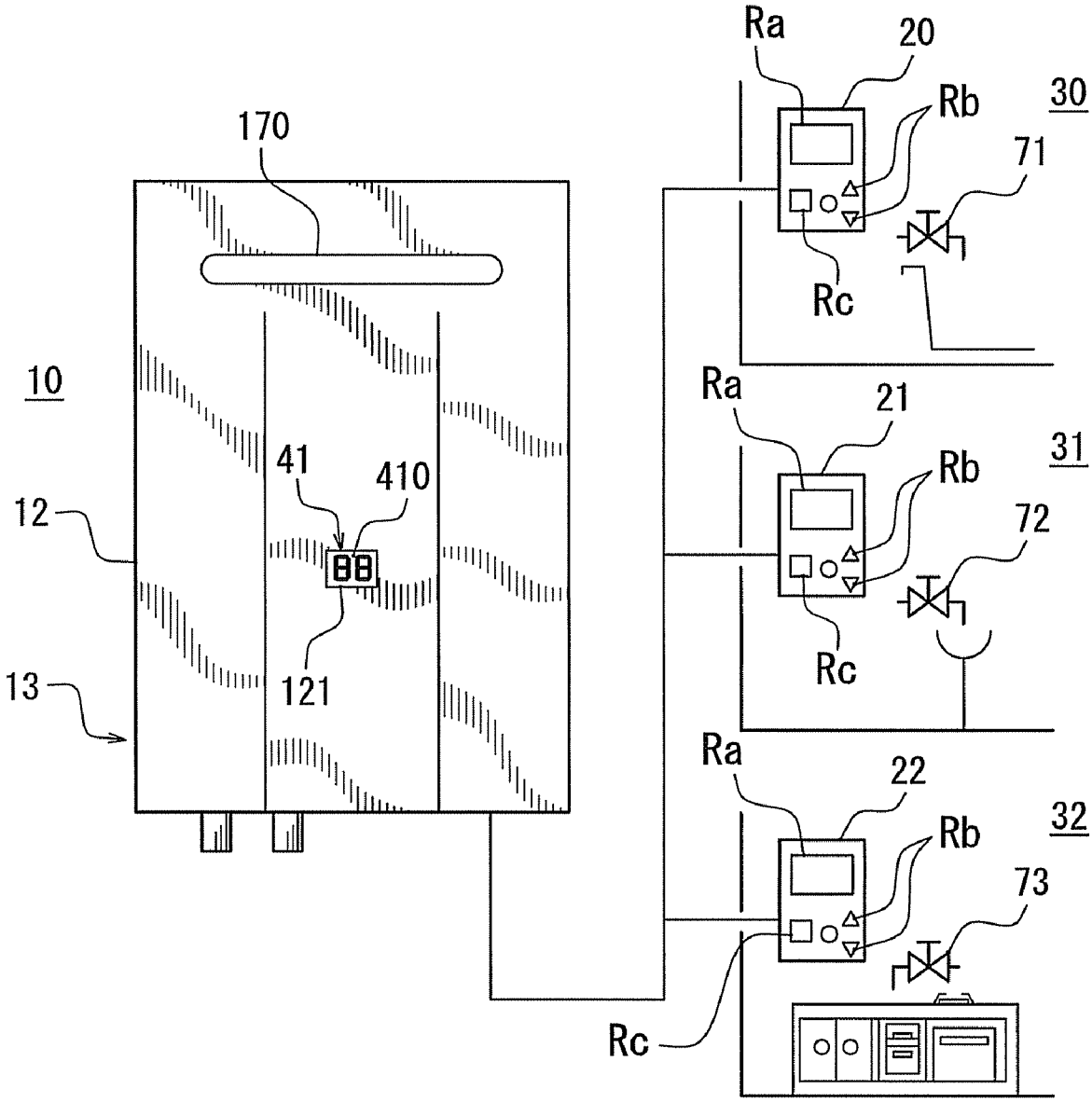
FIG. 1 is a schematic view showing a connected state between a device body and a remote control unit according to an embodiment of the present invention.

Referring to the drawings, the best mode for carrying out the present invention is described below.

As shown in FIG. 1, a water heating apparatus according to the embodiment includes a device body 10 for heating and producing hot water, and remote control units 20, 21 and 22 for remotely operating the device body 10. The remote control units 20, 21 and 22 are mounted on wall surfaces of a bathroom 30, a lavatory 31 and a kitchen 32, respectively. Each of the remote control units 20, 21 and 22 is provided with a temperature setting button Rb, a remote control unit display Ra for displaying a temperature which is set by the temperature setting button Rb, and an operation button Rc. Hot water faucets 71, 72 and 73 are disposed in the bathroom 30, the lavatory 31 and the kitchen 32, respectively. Details of each part are described below.

<Device Body>

Figure 2:
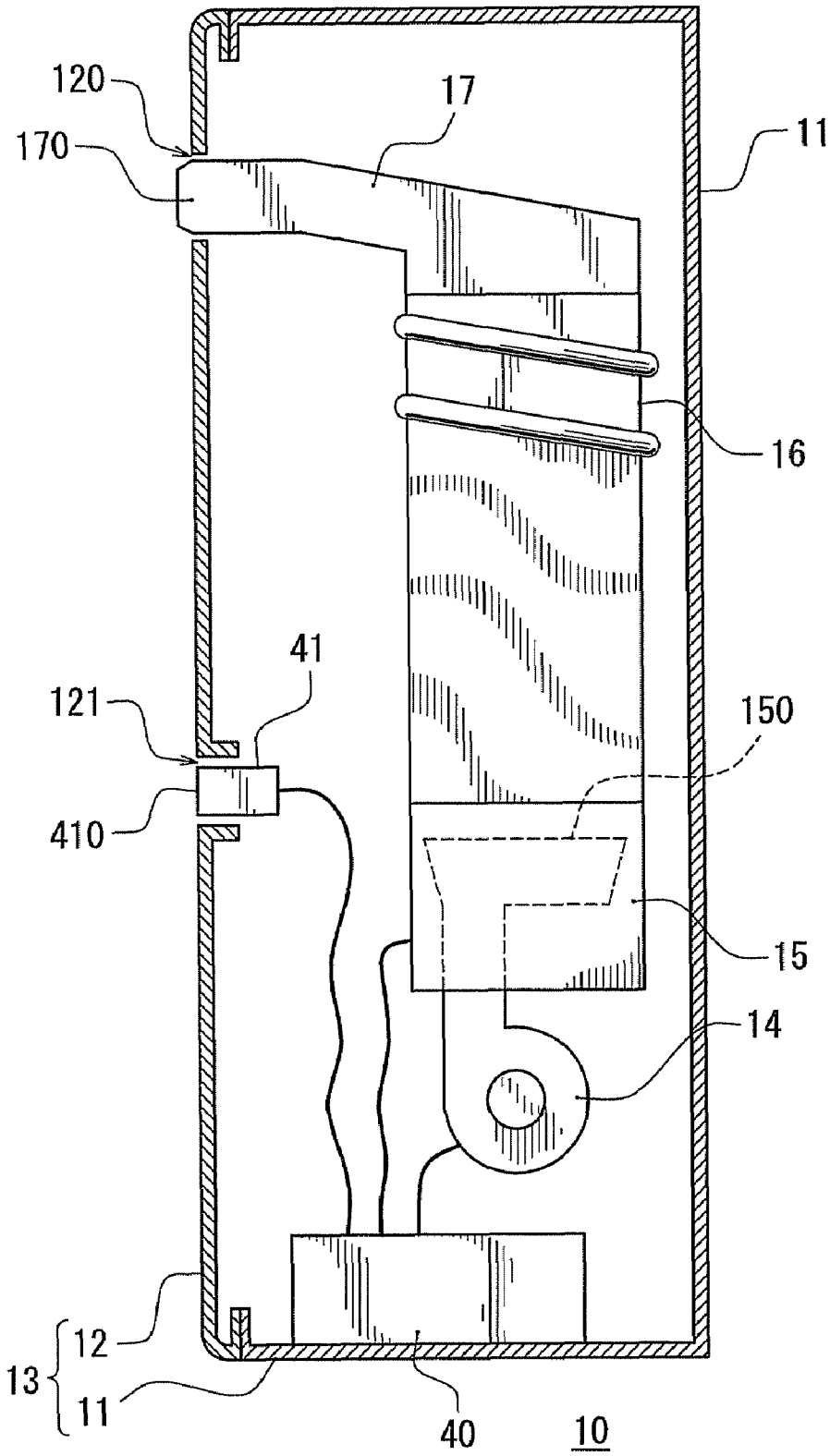
FIG. 2 is a schematic cross-sectional view showing the device body according to the embodiment of the present invention.

As shown in FIG. 2, the device body 10 comprises an outer casing 13, and the front opening of rectangular box-shaped case body 11 is covered by a front lid 12. The front lid 12 is detachably mounted on the case body 11 with a screw (not shown).

The case body 11 is provided therein with a combustor 15 having a gas burner 150. Combustion air is supplied to the gas burner 150 from an air-supply fan 14. A heat exchanger 16 is disposed above the combustor 15, and an exhaust pipe 17 is disposed above the heat exchanger 16. An exhaust port 170 which is on the tip end of the exhaust pipe 17 is inserted into a through hole 120 formed in the front lid 12, and whereby combusted exhaust gas generated in the combustor 15 passes through the exhaust pipe 17 from the heat exchanger 16 and is discharged into the atmosphere from the exhaust port 170 on the tip end of the exhaust pipe 17.

A control apparatus 40 is disposed on a lower portion of the case body 11. The air-supply fan 14, the combustor 15, and a seven-segment LED-type display unit 41 in which seven light-emitting diodes are arranged in a "8" shape, are connected to the control unit 40 through wires. The display 410 of the display unit 41 is located in a window 121 formed in the front lid 12. Therefore, the display 410 of the display unit 41 can be visually checked from the exterior through the window 121 without detaching the front lid 12 from the case body 11. Display unit 41 indicates double-digit alphanumeric characters with the seven-segment LED.

<Circuit Configuration>

Figure 3:
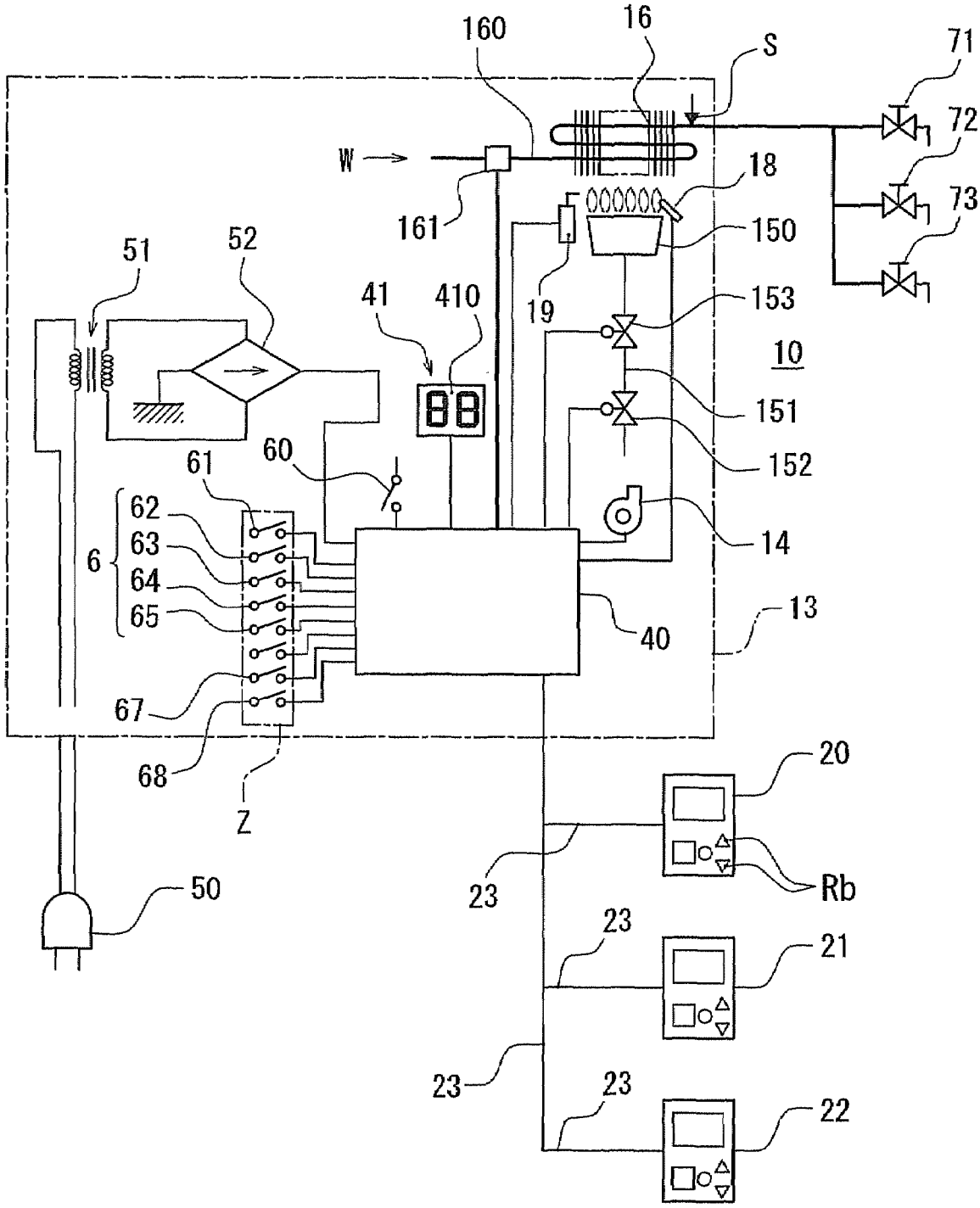
FIG. 3 is a schematic view showing an electric circuit of a water heating apparatus according to the embodiment of the present invention.

FIG. 3 is a schematic view showing an electric circuit of the device body 10. A commercial power source supplied from a power source plug 50 is reduced in voltage by a transformer 51, and then is rectified by a rectifier circuit 52 and becomes a DC power source. This DC power source is supplied to a power source terminal of the control apparatus 40.

A gas base valve 152 inserted into a gas circuit 151 to a gas burner 150 which heats the heat exchanger 16, and a gas proportional valve 153 are connected to the control apparatus 40 through wires. The minimum opening of the gas proportional valve 153 is adjusted by manually rotating an adjusting screw (not shown) provided on the gas proportional valve 153. Further, a flame rod 18 which detects flame of the gas burner 150, an ignition electrode 19 for igniting the gas burner 150, and a combustion air-supply fan 14 are connected to the control apparatus 40 through wires.

A gas kind change-over switch 60, a display unit 41 which is exposed outside through the window 121 formed in the front lid 12 of the outer casing 13, and a flow rate sensor 161 which detects a flow rate of water W in a water passage 160 heated by the heat exchanger 16 are connected to the control apparatus 40 through wires. The hot water faucets 71, 72 and 73 respectively disposed in the bathroom 30, the lavatory 31 and the kitchen 32 are connected to a downstream portion of the water passage 160 in a branch manner.

The remote control units 20, 21 and 22 are connected to the control apparatus 40 through communication lines 23 in parallel. Further, an auxiliary temperature setting unit 6 is connected to the control apparatus 40 through a wire. The auxiliary temperature setting unit 6 is for setting a temperature of temperature-fixed hot water when a hot water temperature fixed-type water heating apparatus which has the device body not connected to a remote control unit is used. According to the embodiment, the auxiliary temperature setting unit 6 includes an auxiliary switch 61, and second switch 62 to fifth switch 65 of 8-bit-type DIP switch Z. The temperature of the temperature-fixed hot water is set by combinations of ON and OFF of the second switch 62 to fifth switch 65.

The seventh switch 67 and the eighth switch 68 are operated to set the opening of the gas proportional valve 153 and the number of revolutions of a fan in accordance with kinds of gas to be used such as LPG and natural gas. These switches are operated together with the gas kind change-over switch 60. According to this embodiment, when the opening of the gas proportional valve 153 is set in accordance with the kinds of gas, the gas kind change-over switch 60 is first changed over in accordance with the kind of gas. Then, a relation between current of the proportional valve 153 and the number of revolutions of the air-supply fan 14 is set. Next, the seventh switch 67 and the eighth switch 68 of the DIP switch Z are switched. If the seventh switch 67 is switched ON and the eighth switch 68 is switched OFF as shown in FIG. 4, the minimum proportional valve current is supplied to the gas proportional valve 153, and the gas burner 150 is maintained in a forced low combustion state. If both the seventh switch 67 and the eighth switch 68 are switched ON, the maximum proportional valve current is supplied to the gas proportional valve 153, and the gas burner 150 is maintained in a forced high combustion state.

<Device Installation Operation>

The installation operation of the device body 10 is carried out in the following manner.

The device body 10 is installed in the outdoor device installing place, and the remote control units 20, 21 and 22 are installed in the bathroom 30, the lavatory 31 and the kitchen 32, respectively. The remote control units 20, 21 and 22, and the control apparatus 40 in the device body 10 are connected to each other in parallel through the communication lines 23.

<Control Operation>

Figure 5:
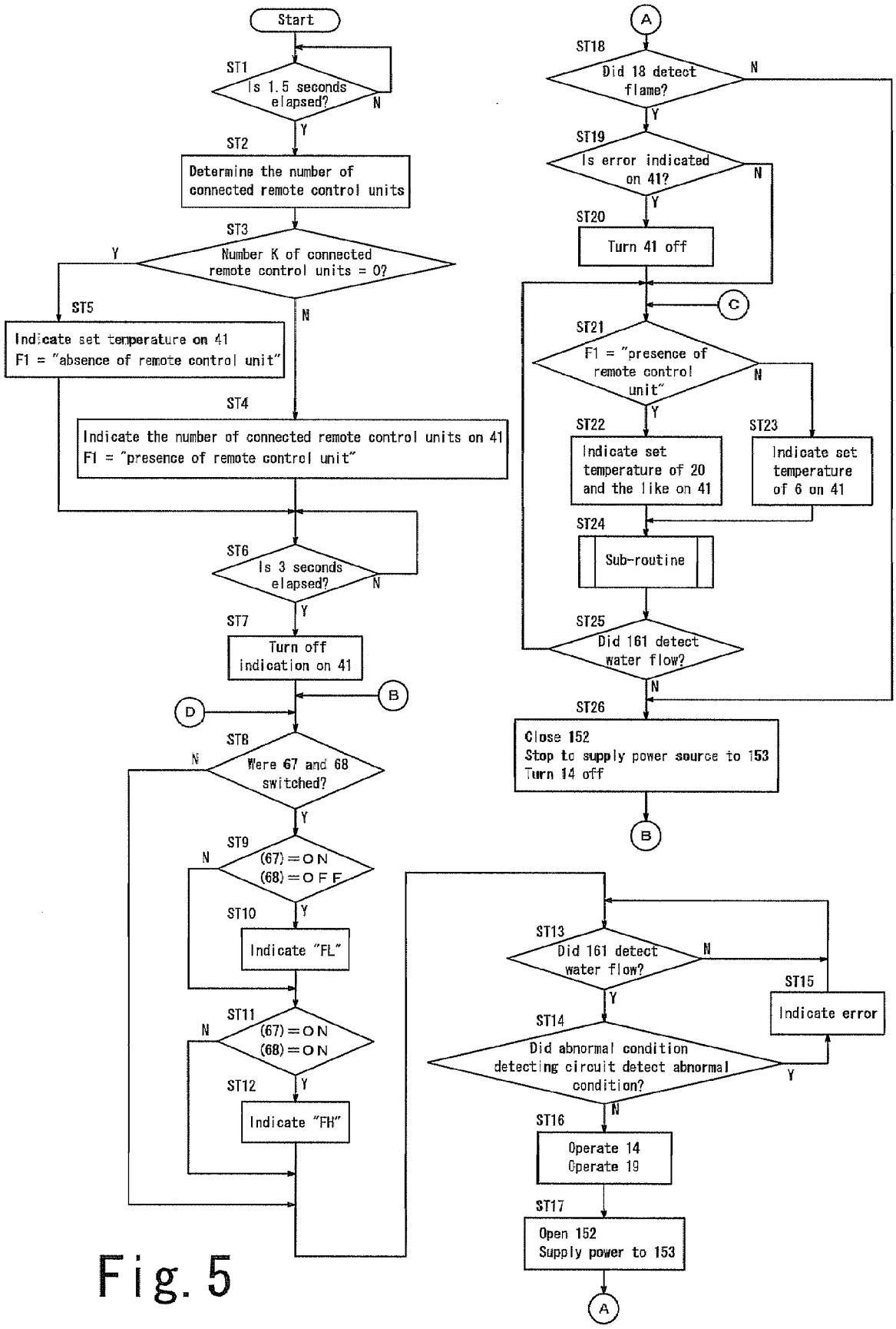
FIG. 5 is a flowchart showing a control operation of a water heating apparatus according to the embodiment of the present invention.

A microcomputer which executes a control program having contents shown in a flowchart in FIG. 5 is stored in the control apparatus 40 of the device body 10. A control operation of the hot water heating apparatus of the embodiment is described in accordance with the flowchart in FIG. 5.

First, the power supply plug 50 of the device body 10 is inserted in a power source plug socket, and supply of power source is started, and then the microcomputer in the control apparatus 40 starts the control operation in accordance with the flowchart in FIG. 5 by DC power source generated by the rectifier circuit 52.

In step 1 (ST1), for example, waiting of 1.5 seconds is executed, and whereby the control operation is brought into a standby state until the electric circuit and the like electrically stabilize.

In step 2 (ST2), signals each are transmitted to each of the remote control units 20, 21 and 22 through the communication lines 23. The number of reply signals replied from each of the remote control units 20, 21 and 22 is counted, and whereby the number K of the connected remote control units 20, 21 and 22 is determined. Therefore, according to the embodiment, the number of connected remote control units is determined as "3". That is, in this embodiment, a function portion of the microcomputer which repeatedly transmits signals to the remote control units 20, 21 and 22 and which counts the number of the reply signals replied from the remote control units 20, 21 and 22 corresponds to a "connection-number counter".

In step 3 (ST3), if the microcomputer determines that the number K of connected remote control units 20, 21 and 22 is not "0", the number K of connected remote control units is indicated on the display 410 of the display unit 41 of the device body 10 in step 4 (ST4). Accordingly, the installation operator of the water heating apparatus can visually checks the number of connected remote control units indicated on the display 410 at the installing place, and the installation operator can easily confirm whether the intended number of the remote control units to be installed and the number of actually installed remote control units match with each other. As a result, it is unnecessary for the installation operator to walk to all the installed places of the remote control units such as the bathroom 30 to check the number of actually installed remote control units, and whereby the confirming operation can be facilitated.

Since the installation operator confirms whether the intended number of the remote control units to be installed and the number of actually installed remote control units match with each other, it is also possible to confirm whether the communication line which connects the remote control unit and the device body is normally wired.

Also, if the microcomputer determines that the number of connected remote control units 20, 21 and 22 is not "0", data indicating "presence of remote control unit" is written in a remote control unit presence/absence flag F1 in step 4 (ST4).

In step 3 (ST3), if the microcomputer determines that the number K of connected remote control units is "0", a temperature set by the auxiliary temperature setting unit 6 is indicated on the display 410 of the display unit 41 instead of displaying the number K of connected remote control units in step 5 (ST5). Therefore, when a water heating apparatus which has the device body not connected to a remote control unit is installed (i.e., in the case of a water heating apparatus of a hot water temperature fixed type), the installation operator can confirm that a water heating apparatus of hot water temperature fixed type is installed by checking the temperature indicated on the display unit 41. The installation operator can also confirm whether there is no error in the set temperature set by the auxiliary temperature setting unit 6. In the embodiment, a temperature range which can be set by the auxiliary temperature setting unit 6 is limited to a range of 40° C. to 85° C., and the maximum number of remote control units to be connected is limited to four. Therefore, the numeric value of the maximum number of units to be connected is smaller than the possible temperature by one digit. Thus, by checking the number of digits of a numeric value indicated on the display 410 of the display unit 41, it is possible to determine whether the indicated numeric value is a temperature set by the auxiliary temperature setting unit 6 or the number K of the connected remote control units 20 and the like.

Next, in step 6 (ST6), waiting of three seconds is executed and then, the display on the display unit 41 is turned off in step 7 (ST7).

Figure 6:
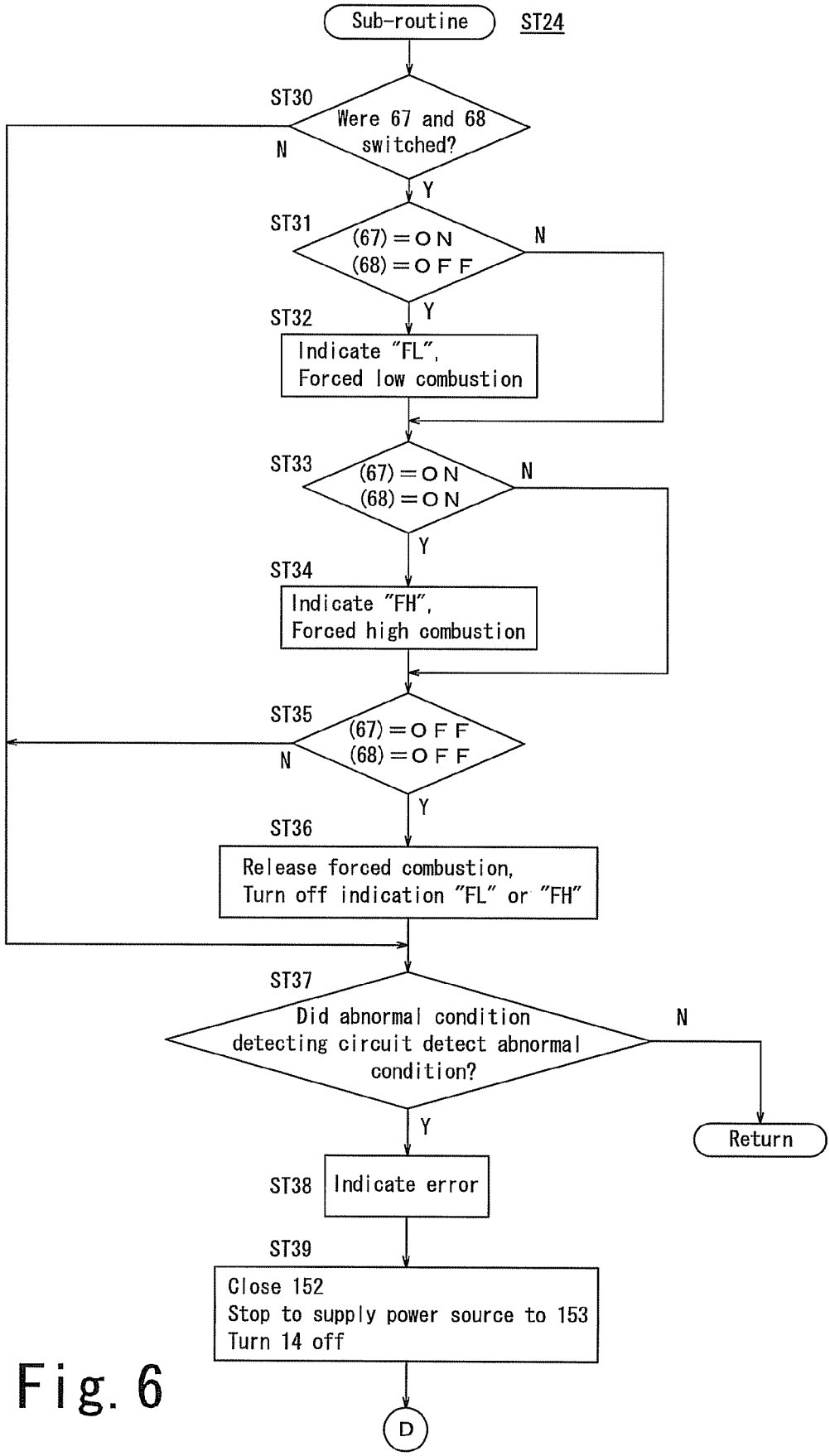
FIG. 6 is a flowchart showing a sub-routine of a gas kind change-over operation of a control operation in the water heating apparatus according to the embodiment of the present invention.

Next, operation of the display unit 41 required when kinds of gas to be used, such as LPG and natural gas, is changed over is controlled in step 8 (ST8) to step 12 (ST12). Step 8 (ST8) to step 12 (ST12) only corresponds to operation carried out by the display unit 41 in a sub-routine in FIG. 6 showing the gas kind change-over operation described below. Details thereof are described in the sub-routine in FIG. 6 and therefore, outline operation of the display unit 41 is described below.

If the microcomputer determines that the seventh switch 67 and the eighth switch 68 are switched in step 8 (ST8), and that the seventh switch 67 is switched ON and the eighth switch 68 is switched OFF in step 9 (ST9), characters "FL" (indicating that the gas burner 150 is maintained in a forced low combustion state) is indicated on the display unit 41 in step 10 (ST10). Next, if the microcomputer determines that both the seventh switch 67 and the eighth switch 68 are switched ON in step 11 (ST11), characters "FH" (indicating that the gas burner 150 is maintained in a forced high combustion state) is indicated on the display unit 41 in step 12 (ST12).

After the installation operation is completed in this manner, a user starts using the water heating apparatus. The water heating apparatus of the embodiment has the following structure in a case where abnormal conditions occur during use. When the hot water faucets 71, 72 and 73 are opened and hot water is supplied, the flow rate sensor 161 detects the water flow in the water passage 160 of the heat exchanger 16 (step 13 (ST13)). In response to the detection signal, the device body 10 starts operating. First, as a preparatory stage, an abnormal condition such as a short circuit or a break of electric parts, for example, the gas proportional valve 153 and the flame rod 18, is detected in step 14 (ST14). That is, the abnormal condition such as the short circuit and the break is detected based on the output of an abnormal condition detection circuit (not shown) which monitors the abnormal condition of the gas proportional valve 153, the flame rod 18 and the like. When any abnormal condition is detected, error codes (e.g., alphanumeric characters) which are preset in accordance with kinds of abnormal conditions are indicated on the display 410 of the display unit 41 (step 15 (ST15)). Thereafter, control is returned to step 13 (ST13). Control operations in step 13 (ST13) to step 15 (ST15) are repeated until no abnormal condition is detected. The hot water faucet 71 or the like is closed and repair for resolving the abnormal condition is carried out while repeating the above control and then, if the hot water faucet 71 or the like is opened, the control is branched from step 14 (ST14) to step 16 (ST16) described below. In this case, display of the error codes is maintained on the display 410 of the display unit 41. Accordingly, a repairer can confirm a record of abnormal condition detection.

If no abnormal condition is detected when step 14 (ST14) is executed, in step 16 (ST16), the air-supply fan 14 is operated, supply of air to the gas burner 150 is started, the ignition electrode 19 is operated, and the ignition spark is repeatedly emitted to the gas burner 150. Then, the gas base valve 152 is opened, and energization to the gas proportional valve 153 is started in step 17 (ST17). Accordingly, gas discharged from the gas burner 150 is ignited from the ignition electrode 19 and gas is combusted.

Next, in step 18 (ST18), the microcomputer determines whether the flame rod 18 detects flame of the gas burner 150. If the flame is detected, the microcomputer determines whether an error indication is indicated on the display unit 41 in step 19 (ST19). If the error indication is indicated, the indication on the display unit 41 is turned off in step 20 (ST20). Accordingly, when the error code is indicated on the display unit 41 in step 15 (ST15), the error code is indicated until the flame rod 18 detects flame. This situation is different from a situation in which the error code is turned off when a user who recognized an abnormal condition of the device closes the hot water faucet 71 or the like. Therefore, there is a merit that the repairer can confirm the error code when the repairer repairs after a user closes the hot water faucet 71 or the like.

Next, contents of the remote control unit presence/absence flag F1 are determined in step 21 (ST21). If the F1 indicates "presence of remote control unit", step 22 (ST22) is executed, and a temperature set by the remote control unit 20 is indicated on the display unit 41 of the device body 10. On the other hand, if the remote control unit presence/absence flag F1 indicates "absence of remote control unit", step 23 (ST23) is executed, and a temperature set by the auxiliary temperature setting unit 6 (setting by combinations of ON and OFF of second switch 62 to fifth switch 65 of DIP switch Z) is indicated on the display unit 41.

The water heating apparatus according to the embodiment has the following structure considering the case where the kind of gas is changed over after the water heating apparatus is installed. When the gas kind is changed over, the sub-routine of the gas kind change-over control is executed in step 24 (ST24). FIG. 6 shows contents of the sub-routine (ST24) of the gas kind change-over control. First, the microcomputer determines whether the switching operation of the seventh switch 67 and the eighth switch 68 of the DIP switch Z was carried out in step 30 (ST30). If the switching operation was not carried out (i.e., the gas kind change-over operation was not carried out), control is shifted to step 37 (ST37) described below for determining whether abnormal condition occurs in electric parts and the like. On the other hand, when the microcomputer determines that the seventh switch 67 or the eighth switch 68 of the auxiliary temperature setting unit 6 is ON in step 30 (ST30) and that the seventh switch 67 is switched ON and the eighth switch 68 is switched OFF in step 31 (ST31), the minimum proportional valve current is supplied to the gas proportional valve 153 in step 32 (ST32). Accordingly, the gas burner 150 is brought into the forced low combustion state, and "FL" (indicating that the gas burner 150 is maintained in the forced low combustion state) is indicated on the display unit 41. When the gas burner 150 is maintained in the forced low combustion state, a gas kind change-over operator manually rotates an adjusting screw provided on the gas proportional valve 153 so that the lower limit combustion with the changed gas kind can normally be maintained.

Next, when the microcomputer determines that both the seventh switch 67 and the eighth switch 68 are switched ON in step 33 (ST33), the maximum proportional valve current is supplied to the gas proportional valve 153 in step 34 (ST34). Accordingly, the gas burner 150 is brought into the forced high combustion state, and "FH" (indicating that the gas burner 150 is maintained in the forced high combustion state) is indicated on the display unit 41. When the gas burner 150 is maintained in the forced high combustion state, a gas kind change-over operator adjusts such that the upper limit combustion with the switched gas kind can be maintained normally using an operating section (not shown).

If the gas kind change-over operation is completed, the gas kind change-over operator switches both the seventh switch 67 and the eighth switch 68 into their initial OFF states. Then, this switched state is determined in step 35 (ST35), and the control of the forced low combustion or the forced high combustion is released in step 36 (ST36). Accordingly, the opening of the gas proportional valve 153 is adjusted so that hot water of temperature set by the auxiliary temperature setting unit 6 or remote control unit 20 or the like can be heated and produced, and normal hot water supply control is executed. When hot water of temperature set by the auxiliary temperature setting unit 6 or remote control unit 20 or the like is heated and produced, the opening of the gas proportional valve 153 is adjusted such that the temperature detected by the hot water temperature sensor S provided on the outlet side of the heat exchanger 16 approaches a temperature set by the auxiliary temperature setting unit 6.

Also, the indication of the display unit 41 is turned off in step 36 (ST36). Accordingly, "FL" (indicating that the gas burner 150 is maintained in the forced low combustion state) or "FH" (indicating that the gas burner 150 is maintained in the forced high combustion state) indicated on the display 410 of the display unit 41 is turned off.

Next, the similar abnormal condition detecting operation with that of the step 14 (ST14) is executed in step 37 (ST37). When an abnormal condition is detected, error codes which are previously set in accordance with kinds of abnormal conditions are indicated on the display 410 of the display unit 41 (step 38 (ST38)). Then, the gas base valve 152 is closed, supply of electricity to the gas proportional valve 153 is stopped, and the air-supply fan 14 is stopped in step 39 (ST39), and the control operation is returned to step 7 (ST7) shown in FIG. 5.

When no abnormal condition is detected in step 37 (ST37) in FIG. 6, the control is returned to step 25 (ST25) in FIG. 5 from the sub-routine. Then, the control operations in step 21 (ST21) to step 25 (ST25) are repeated until the microcomputer detects the operation to stop hot water supply carried out by closing the hot water faucets 71, 72 and 73 and the like.

If the operation to stop hot water supply is detected in step 25 (ST25), the gas base valve 152 is closed, the power supply to the gas proportional valve 153 is stopped, and the air-supply fan 14 is stopped in step 26 (ST26). After then, the control is returned to step 8 (ST8).

Even when no flame is detected by the flame rod 18 in step 18 (ST18), step 26 (ST26) is executed.

As described above in detail, according to one aspect of the invention, there is provided a water heating apparatus comprising:

a device body for heating and producing hot water that is capable of connecting to one or more remote control units for remotely operating the device body, the device body having an outer casing;

a connection-number counter disposed within the outer casing of the device body for determining the number of remote control units upon powering-up the device body; and a display unit disposed within the outer casing of the device body for indicating the number of the connected remote control units determined by the connection-number counter, wherein a display of the display unit is visible from the exterior through a window formed in the outer casing.

According to the above feature, for example, the device body is disposed in an outdoor device installing place, and the remote control unit is mounted on a wall surface of the kitchen, the living room or the bathroom. Then, the remote control unit and the device body are connected to each other through a communication line, thereby completing the installation operation. When the power source is supplied to the device body after the installation, the number of connected remote control units is indicated on the display of the display unit. Since the display of the display unit is visible from the exterior through a window formed in the outer casing, the installation operator of the water heating apparatus can visually check the number of connected remote control units indicated on the display at the outdoor device installing place. Accordingly, the installation operator can easily confirm whether the intended number of the remote control units to be installed and the number of actually installed remote control units match with each other.

Further, since the installation operator can confirm whether the intended number of the remote control units to be installed and the number of actually installed remote control units match with each other, it is possible to confirm whether the communication line which connects the remote control unit and the device body is normally wired. Therefore, according to the above feature, the installation operation can be facilitated whether a water heating apparatus having the device body for heating and producing hot water connected to a remote control unit for remotely operating the device body, or a water heating apparatus having the device body for heating and producing hot water not connected to the remote control unit for remotely operating the device body is installed.

The water heating apparatus above may further include an auxiliary temperature setting unit disposed within the outer casing of the device body for setting a temperature of hot water to be heated and produced by the device body, wherein when the number of connected remote control units determined by the connection-number counter is zero, the temperature set by the auxiliary temperature setting unit is indicated on the display of the display unit upon powering-up the device body.

According to the above feature, it is useful when a hot water temperature-fixed type water heating apparatus which has the device body not connected to a remote control unit is installed. Specifically, when the power source is supplied to the device body after the set temperature is set by the auxiliary temperature setting unit, the number of connected remote control units determined by the connection-number counter is zero. Then, when the number of connected remote control units is zero, the set temperature set by the auxiliary temperature setting unit is indicated on the display of the display unit instead of displaying the number of connected remote control units. Accordingly, the installation operator can confirm that the hot water temperature-fixed type is installed by checking the temperature indicated on the display unit. The installation operator can also confirm whether there is no error in the set temperature set by the auxiliary temperature setting unit.

The auxiliary temperature setting unit above may have a DIP switch.

Although kinds of the auxiliary temperature setting unit are not limited, according to the above feature, it is possible to simplify the entire structure of the water heating apparatus comparing with that of a water heating apparatus having an auxiliary temperature setting unit with a numeric keypad to set a temperature.

Furthermore, the indication of the number of connected remote control units or the indication of a temperature set by the auxiliary temperature setting unit may be released when predetermined time is elapsed after powering-up the device body.

According to the above feature, since the indications are released when the predetermined time is elapsed, it is possible to indicate other information such as control error on the display. Accordingly, it has a great deal of potential in industry.

In the water heating apparatus above, the connection-number counter may determine the number of remote control units by transmitting a signal to each of the remote control units through a communication line and counting the number of reply signals replied from each of the remote control units.

According to the above feature, it is possible to indicate the number of connected remote control units or the temperature set by the auxiliary temperature setting unit upon powering-up the device body.

According to an embodiment of the present invention, the water heating apparatus above may further include an auxiliary temperature setting unit disposed within the outer casing of the device body for setting a temperature of hot water to be heated and produced by the device body, wherein the connection-number counter determines the number of remote control units by transmitting a signal to each of the remote control units through a communication line and counting the number of reply signals replied from each of the remote control units;

when the number of connected remote control units determined by the connection-number counter is not zero, the number of reply signals is indicated on the display of the display unit upon powering-up the device body, and when the number of connected remote control units determined by the connection-number counter is zero, the temperature set by the auxiliary temperature setting unit is indicated on the display of the display unit upon powering-up the device body.

According to the above feature, it is possible to provide the water heating apparatus to facilitate the installation operation.

The present application claims priority based on a Japanese Patent Application No. 2006-151124 filed on May 31, 2006, the content of which is hereby incorporated by reference in its entirely.

Although the present invention has been described in detail, the foregoing descriptions are merely exemplary at all aspects, and do not limit the present invention thereto. It should be understood that an enormous number of unillustrated modifications may be assumed without departing from the scope of the present invention.

What is claimed is:

1. A water heating apparatus comprising:

a device body for heating and producing hot water that is capable of connecting to one or more remote control units for remotely operating the device body, the device body having an outer casing;

a connection-number counter disposed within the outer casing of the device body for determining the number of remote control units upon powering-up the device body; and a display unit disposed within the outer casing of the device body for indicating the number of the connected remote control units determined by the connection-number counter, wherein a display of the display unit is visible from the exterior through a window formed in the outer casing.

2. The water heating apparatus according to claim 1, further comprising an auxiliary temperature setting unit disposed within the outer casing of the device body for setting a temperature of hot water to be heated and produced by the device body, wherein when the number of connected remote control units determined by the connection-number counter is zero, the temperature set by the auxiliary temperature setting unit is indicated on the display of the display unit upon powering-up the device body.

3. The water heating apparatus according to claim 2, wherein the auxiliary temperature setting unit has a DIP switch.

4. The water heating apparatus according to claim 1, wherein the indication of the number of connected remote control units or the indication of a temperature set by the auxiliary temperature setting unit is released when predetermined time is elapsed after powering-up the device body.

5. The water heating apparatus according to claim 1, wherein the connection-number counter determines the number of remote control units by transmitting a signal to each of the remote control units through a communication line and counting the number of reply signals replied from each of the remote control units.

6. The water heating apparatus according to claim 1, further comprising an auxiliary temperature setting unit disposed within the outer casing of the device body for setting a temperature of hot water to be heated and produced by the device body, wherein the connection-number counter determines the number of remote control units by transmitting a signal to each of the remote control units through a communication line and counting the number of reply signals replied from each of the remote control units;

when the number of connected remote control units determined by the connection-number counter is not zero, the number of reply signals is indicated on the display of the display unit upon powering-up the device body, and when the number of connected remote control units determined by the connection-number counter is zero, the temperature set by the auxiliary temperature setting unit is indicated on the display of the display unit upon powering-up the device body.

* * * * *